US005746166A

United States Patent [19]

Valasopoulos

[11] Patent Number: 5,746,166

[45] Date of Patent: May 5, 1998

[54] CAM LOBE WITH OFFSET ANGULAR MOVEMENT

[76] Inventor: Christos Valasopoulos, 22, Koritsas Str., 10447 Athens, Greece

[21] Appl. No.: 507,361

[22] PCT Filed: Nov. 24, 1994

[86] PCT No.: PCT/GR94/00023

§ 371 Date: Aug. 16, 1995

§ 102(e) Date: Aug. 16, 1995

[87] PCT Pub. No.: WO95/16852

PCT Pub. Date: Jun. 22, 1995

[30] Foreign Application Priority Data

Dec. 17, 1993 [GR] Greece ..... 930100517

[51] Int. Cl.[6] ..... F01L 13/00; F01L 1/08

[52] U.S. Cl. ..... 123/90.17; 123/90.6; 75/568 R; 251/251

[58] Field of Search ..... 123/90.15, 90.16, 123/90.17, 90.6; 75/567, 568 R; 251/251

[56] References Cited

U.S. PATENT DOCUMENTS

| | | | |
|---|---|---|---|
| 4,498,352 | 2/1985 | Hedelin | 123/90.17 |
| 4,886,022 | 12/1989 | Nakai | 123/90.17 |
| 5,161,429 | 11/1992 | Elrod | 74/569 |
| 5,168,772 | 12/1992 | Adamis et al. | 123/90.6 |
| 5,307,768 | 5/1994 | Beier et al. | 123/90.17 |
| 5,404,770 | 4/1995 | Kruger | 123/90.17 |
| 5,417,186 | 5/1995 | Elrod et al. | 123/90.17 |
| 5,501,121 | 3/1996 | Beier et al. | 123/90.17 |
| 5,505,168 | 4/1996 | Nagai et al. | 123/90.17 |

FOREIGN PATENT DOCUMENTS

| | | | |
|---|---|---|---|
| A-0582846 | 2/1994 | European Pat. Off. . | |
| A-322489 | 6/1902 | France . | |
| A-517937 | 5/1921 | France . | |
| 3A-37 20 947 | 6/1987 | Germany | F16H 25/10 |
| A-3720947 | 1/1988 | Germany . | |
| C-4137978 | 4/1993 | Germany . | |
| WO-A-91/10047 | 7/1991 | WIPO . | |
| WO-A-93/03261 | 2/1993 | WIPO . | |
| WO-A-94/15075 | 4/1993 | WIPO . | |

OTHER PUBLICATIONS

Patent Abstract of Japan vol. 11, No. 28 (M-577) [2475], Jan. 27, 1987 & JP-A-61 201803, Sep. 6, 1986.

Patent Abstract of Japan vol. 11, No. 135 (M-585) [2582], Apr. 28, 1987 & JP-A-61 275515

*Primary Examiner*—Weilun Lo

*Attorney, Agent, or Firm*—Horst M. Kasper

[57] ABSTRACT

A u-shaped cam lobe (1) has a bulge (9) furnished at one end of the cam lobe (1) which cooperates with a longitudinal groove (10) furnished in a cylindrical shaft (2). The bulge (9) and the longitudinal groove (10) form a joint around which the cam lobe (1) can rotate. The cylindrical shaft (2) has a longitudinal borehole (8) running parallel to a longitudinal axis of the cylindrical shaft (2). Two transverse boreholes (6, 7) run inclined each to other to meet the longitudinal borehole (8). Two balls (4, 5) move inside the transverse boreholes (6, 7) of the cylindrical shaft (2). The two balls (4, 5) cooperate with two recesses (11, 12) furnished in a transmission (3). By shifting the transmission shaft (3) along the longitudinal axis of the cylindrical shaft (2), the balls (4, 5) move and push the cam lobe (1). The cam lobe (1) rotates around a fixed point placed offset from the perpendicular symmetry axis of the cam lobe thereby causing a change, of a lift cam, valve opening time and valve closing time.

14 Claims, 11 Drawing Sheets

CAM LOBE WITH OFFSET ANGULAR MOVEMENT

BACKGROUND OF THE INVENTION

1. Field of the Invention

The invention refers to an apparatus and a method for changing operational characteristics of a valve of an internal combustion engine.

2. Brief Description of the Background of the Invention Including Prior Art

It is well known that the cams of internal combustion engine camshafts during the rotation cause a moving of air in intake valves and exhaust valves of the internal combustion engine, where the lift of the value depends on the cam lift. Furthermore, the cams define the time between the point in time of valve opening and the point in time of valve closing depending on the form and shape of the cam profile. The cams provide the correct timing of the valves, i.e. the opening and closing of each valve at the proper moment relative to the crankshaft position.

Internal combustion engines equipped with camshafts having fixed cams show the maximum torque and the maximum power at a specific RPM number whereas the torque and the momentum decrease at another RPM number.

Systems reducing the above-mentioned disadvantages, have been tested on a very small scale so far, and only in specific types of internal combustion engines. Such systems operate with camshaft systems with inclined fixed cams, where the entire camshaft slides back and forth along the axis of the camshaft, increasing or decreasing, respectively, the valve lift depending on the relevant position of the lifter on the inclined cam. Simultaneously, the camshaft itself has also the ability to turn to some degree with respect to its initial position, thereby changing the timing of the valves.

Other systems, like for example the VTEC system, are using camshafts with more than one fixed cam of different lift strokes, angles, or phases for each valve, and cooperating with a system of multiple rocker arms for each separate operational case.

Systems with camshafts sliding along their axis need a modification of the construction of the internal combustion engine, while in the case of "V" type engines or with the camshaft disposed on one side, the application of the camshafts sliding along their axis is impossible, since the distance between the valve lifters strictly limits any sliding movement of the camshaft.

Other systems having camshafts with a special cam form (e.g. inclined cam), entirely different from the conventional cams used in the market today, require also the use of extremely specialized equipment and machinery for the manufacturing, as well as for the reconditioning of the cams. Therefore, these camshafts cannot have a wide use and their application is extremely limited.

The VTEC system has also a limited application, since its application is not possible or extremely difficult in "V"0 type engines or in engines with the camshaft on one side because the distance between the cams is small, which causes serious problems in the complicated system of multiple rocker arms. Additionally, the application of such system requires not only the construction and manufacture of a totally new camshaft, but also the construction and manufacture of a totally new cylinder head in which the multiple rocker arm system will be fitted. It is important to note at this point that this system is impossible to operate correctly at a high number of rotations per minute (rpm) due to the inertia of the multiple rocker arms at these high velocities.

U.S. Pat. No. 5,161,429A describes a variable cam moving in an angular direction around a point located on the symmetry axis. The variable cam, apart from the complexity of the design and the use of specially shaped cooperating components for the faultless operation, allows only to change the valve timing (phase change and valve opening-closing time duration change), whereas the variable cam has no ability to change the cam lift (and consequently the valve lift).

The German printed patent document No. DE 42 22 477 A1 describes a variable cam which operates either with a movable segment of the cam or with a combination of a fixed segment and of a movable segment. The variable cam with the movable segment allows to change the cam lift but does not offer any significant ability in simultaneously and gradually changing the cam lift as well as the valve timing (phase, opening-closing duration).

SUMMARY OF THE INVENTION

1. Purposes of the Invention

It is an object of the present invention to provide a cam capable of changing a valve lift as well as the valve opening time and the valve closing time.

It is a further object of the present invention to provide an apparatus and method allowing an increase in power output as well as a decrease in fuel consumption, and a pollution reduction.

It is still a further object of the present invention to provide for a reliable and simple apparatus which allows an easy mounting and removal of the cam lobe.

These and other objects and advantages of the present invention will become evident from the description which follows.

2. Brief Description of the Invention

A cam lobe with offset angular movement system can comprise a cylindrical shaft having a longitudinal lubrication borehole running parallel to a longitudinal axis of the rotating cylindrical shaft. A first transverse borehole and a second transverse borehole can be inclined relative to each to other to meet the longitudinal borehole. The cylindrical shaft can also comprise a longitudinal groove furnished in an outer surface of the cylindrical shaft. The longitudinal groove is running parallel to the longitudinal axis of the cylindrical shaft. A cam lobe can be placed on the rotating cylindrical shaft. A vertical symmetry axis of the cam lobe can be perpendicular to a longitudinal axis of the cam lobe. The cam lobe can have a U-shape inner surface having a small recess furnished in the inner surface. A longitudinal bulge shape matching the longitudinal groove of the rotating cylindrical shaft can be furnished on the inner surface of another arm of the cam lobe than where the small recess is furnished. The longitudinal bulge and the longitudinal groove can furnish a joint which joint can be placed in a fixed point of rotation of the cam lobe. The fixed point of rotation of the cam lobe can be placed offset from the perpendicular symmetry axis of the cam lobe. A reciprocating shaft or a transmission shaft can be placed shiftedly inside the longitudinal lubrication borehole of the rotating shaft and can have a first recess and a second recess inclined toward each other in opposite directions. A first sliding ball and a second sliding ball can move inside the first transverse borehole and, respectively, the second transverse borehole of the rotating shaft, wherein the first and the second balls can cooperate with the first recess and, respectively, the second recess of the reciprocating shaft. The first ball can additionally cooperate with the small recess of the cam lobe. By shifting the reciprocating shaft along the longitudinal axis of the rotating cylindrical shaft, the first and the second sliding balls can move and thereby the cam lobe can rotate angularly around the fixed point placed offset from the perpendicular symmetry axis of the cam lobe.

The cam lobe can have a threaded borehole furnished in one arm and a small borehole made in the other arm. The reciprocating shaft can be placed shiftedly inside the longitudinal lubrication borehole of the cylindrical shaft. A shaft borehole can be furnished perpendicular to the lubrication borehole in the cylindrical shaft. The reciprocating shaft can have a transverse opening with two opposite flat parallel walls, inclined with respect to the longitudinal axis of the cylindrical shaft and running perpendicular to the longitudinal axis of the rotating cylindrical shaft. A pin shape matching a transverse opening, the small borehole and threaded borehole can be inserted in the shaft borehole of the cylindrical shaft and the transverse opening of the reciprocating shaft. The pin can connect the rotating cylindrical shaft, the cam lobe and the reciprocating shaft and can furnish a joint around which the cam lobe performs its angular movement. The pin can slide along walls of the transverse opening during shifting the reciprocating shaft inside the cylindrical shaft, creating a gradual uniformly changing angular position of the cam lobe in relation to the rotating cylindrical shaft, changing operational parameters of a valve cooperating with the cam lobe, namely: i) phase ii) lifting iii) opening closing—duration of said valve.

The cylindrical shaft can have a longitudinal borehole running parallel to a longitudinal axis of the rotating cylindrical shaft, a transverse borehole starting at an outer surface of the cylindrical shaft and meeting the longitudinal hole. The transverse borehole can run along a symmetry axis of a cross section of the rotating cylindrical shaft. A longitudinal groove can be furnished in an outer surface of the rotating cylindrical shaft and can run parallel to the longitudinal axis of the rotating cylindrical shaft. At least one cam lobe can be placed on the rotating cylindrical shaft. A spring can be placed in the cylindrical recess and a sliding ball can move inside the cylindrical recess. A small piston having a spherically shaped end can be movably placed in the transverse borehole cooperating with a recess of the cam lobe. The pressure of hydraulic fluid acting on the small piston through the longitudinal borehole of the cylindrical shaft can cause a changing of the angular position of the cam lobe around the fixed point of rotation of the cam lobe thereby changing a distance between a top of the cam lobe and the longitudinal axis of the rotating cylindrical shaft.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 2:
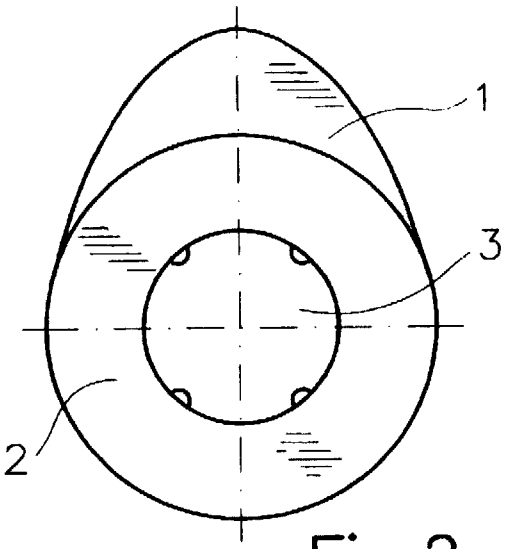
FIG. 2 is a side view of the cam lobe with offset angular movement in the initial position according to FIG. 1.
Figure 5:
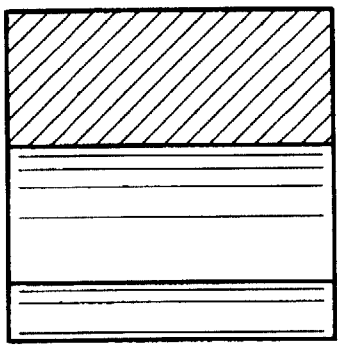
FIG. 5 is a sectional view of the cam lobe along section line 5—5 of FIG. 3.
Figure 1:
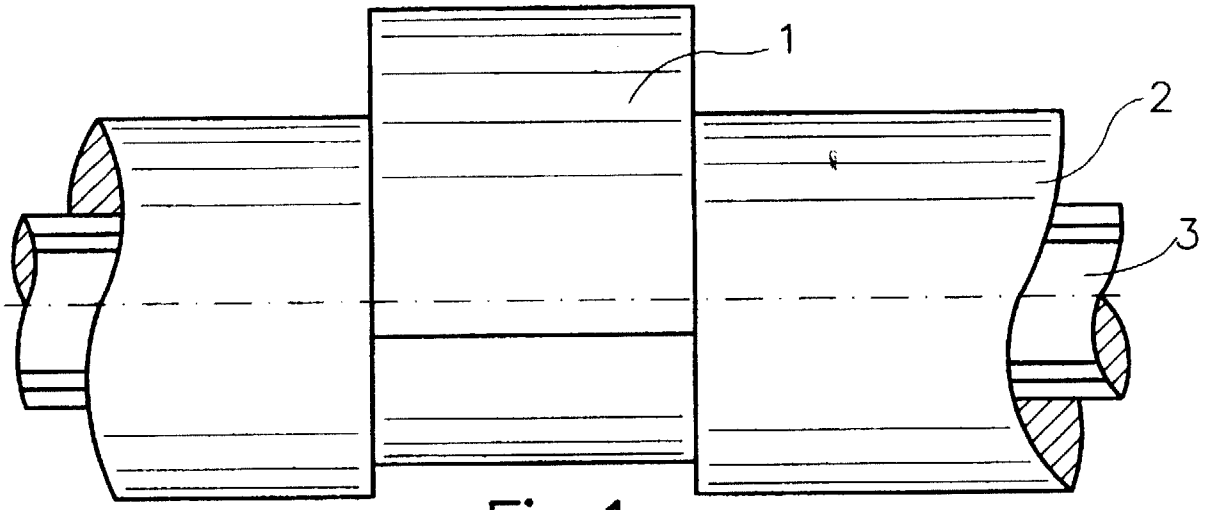
FIG. 1 is a front view of a cam lobe with offset angular movement in an initial position.
Figure 3:
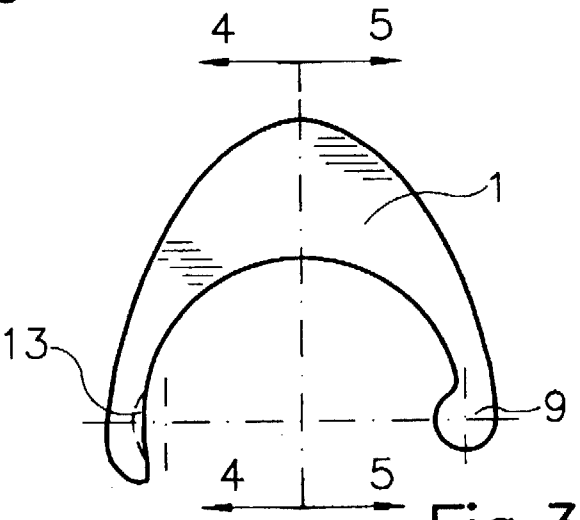
FIG. 3 is a side view of a cam lobe.
Figure 4:
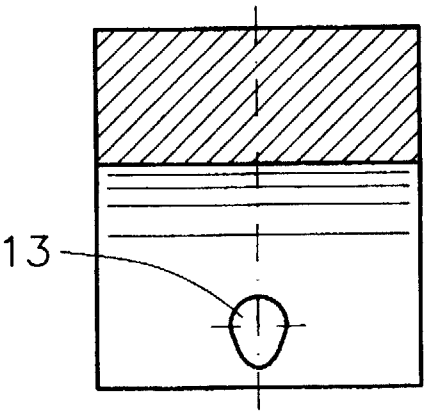
FIG. 4 is a sectional view of the cam lobe along section line 4—4 of FIG. 3.
Figure 6:
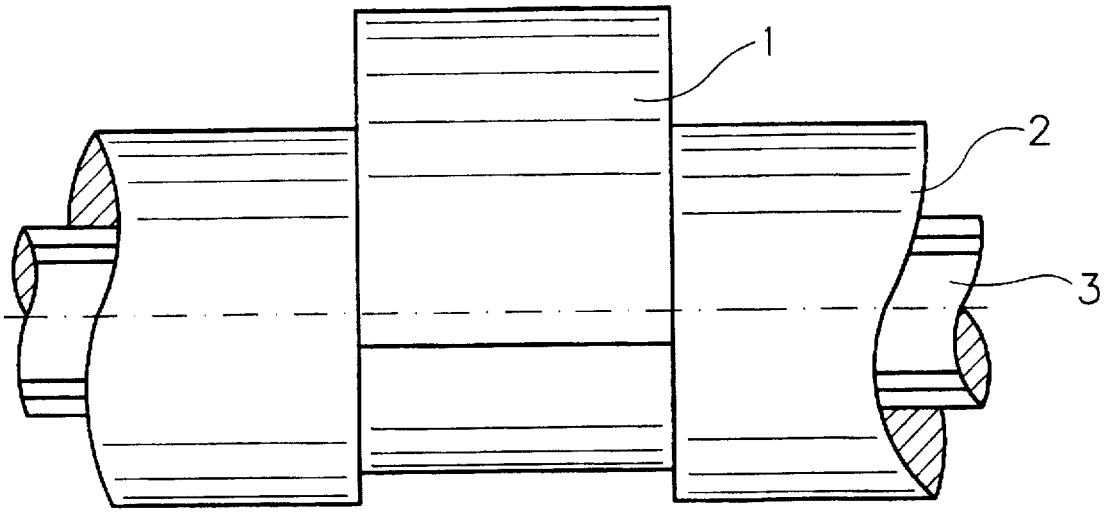
FIG. 6 is a front view of the cam lobe with offset angular movement, in an end position.
Figure 8:
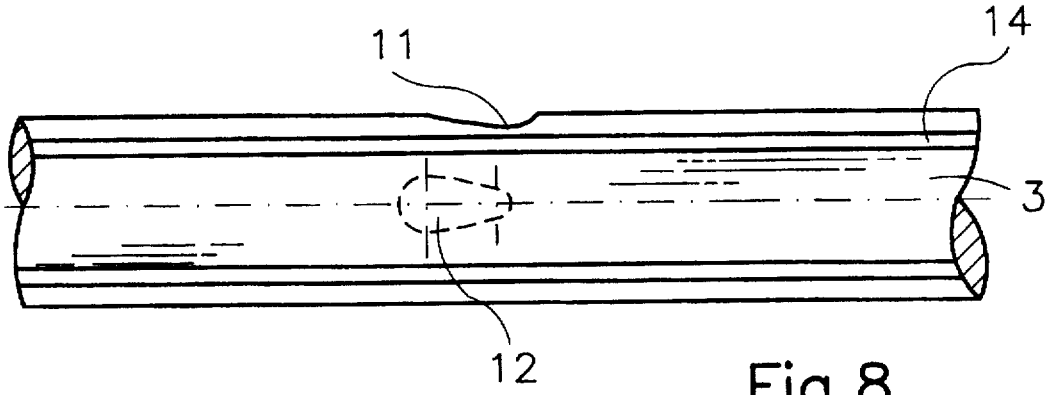
FIG. 8 is a front view of a transmission shaft.
Figure 9:
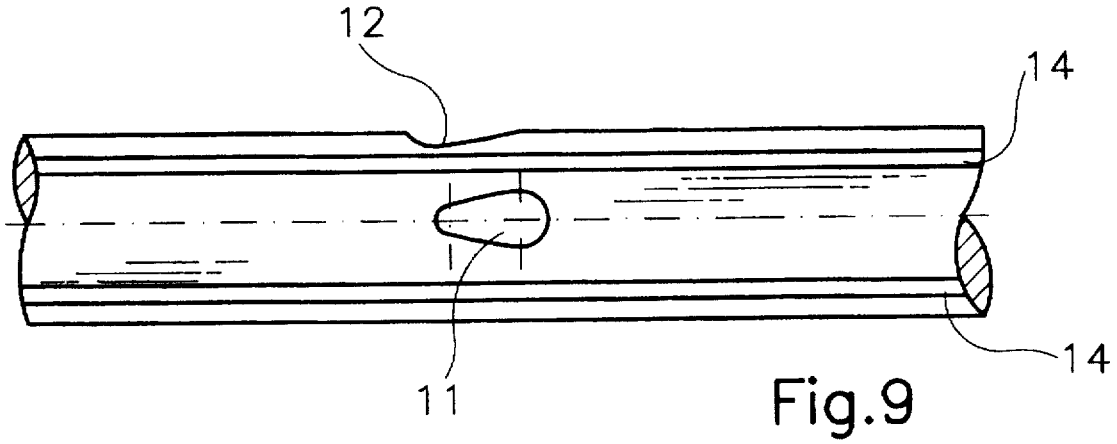
FIG. 9 is a top view of the transmission shaft according to FIG. 8.
Figure 7:
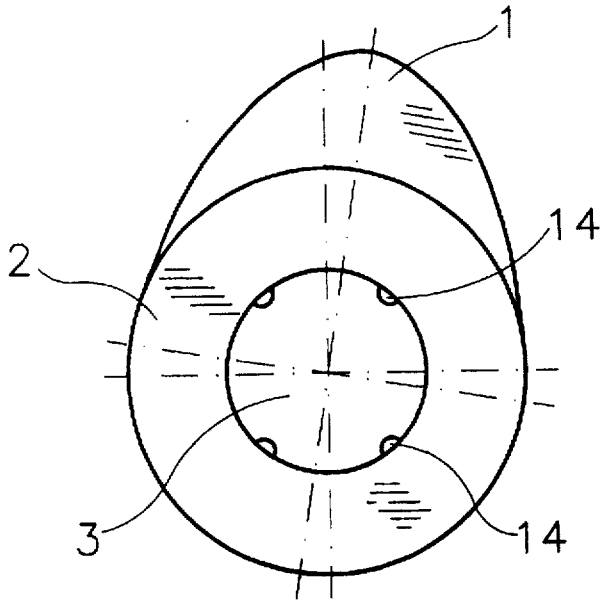
FIG. 7 is a side view of the cam lobe with offset angular momentum, in the end position according to FIG. 6.
Figure 10:
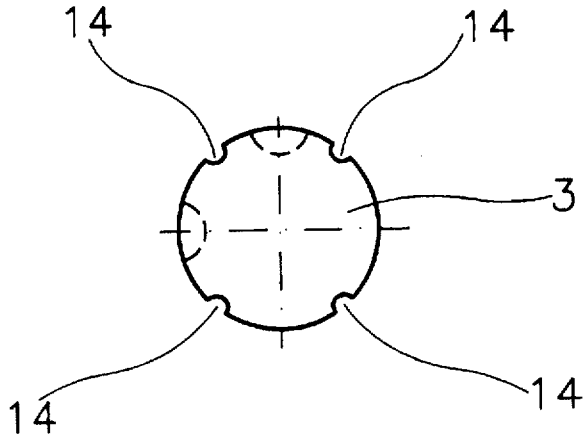
FIG. 10 is a side view of the transmission shaft according to FIG. 8.
Figure 12:
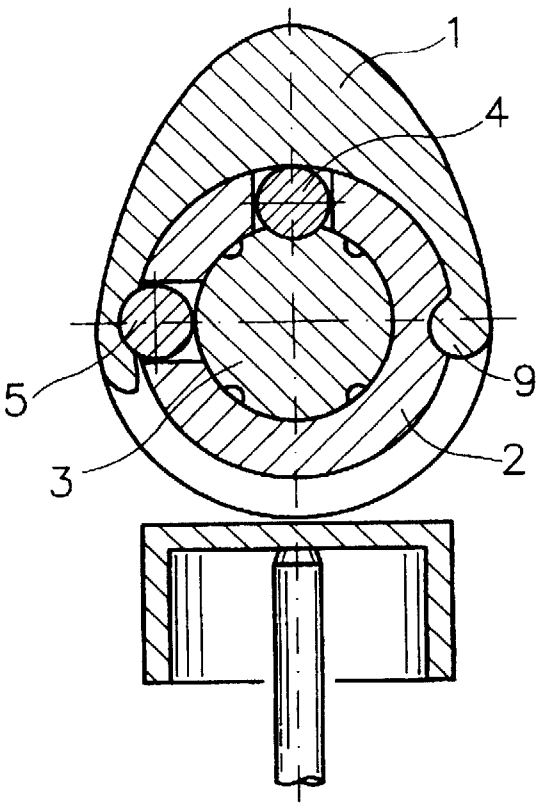
FIG. 12 is a cross-sectional view of the cam lobe with angular movement, along section line 12—12 of FIG. 11.
Figure 11:
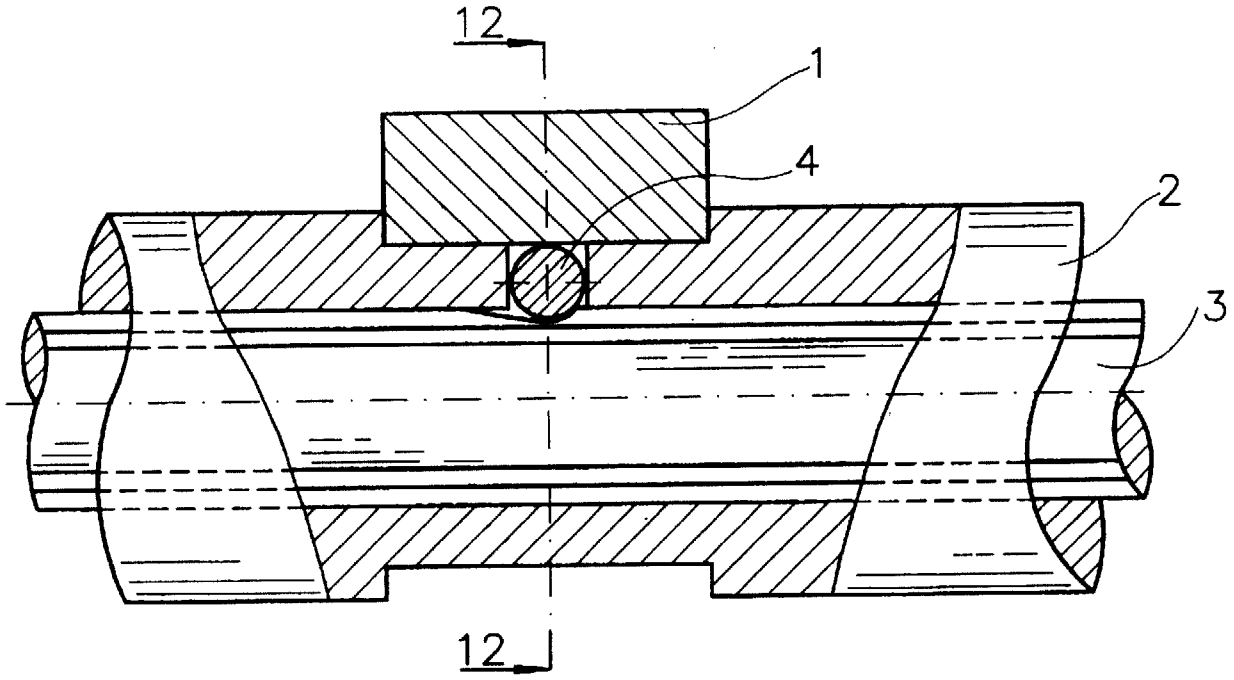
FIG. 11 is a partial sectional view of the cam lobe with angular movement in the initial position.
Figure 14:
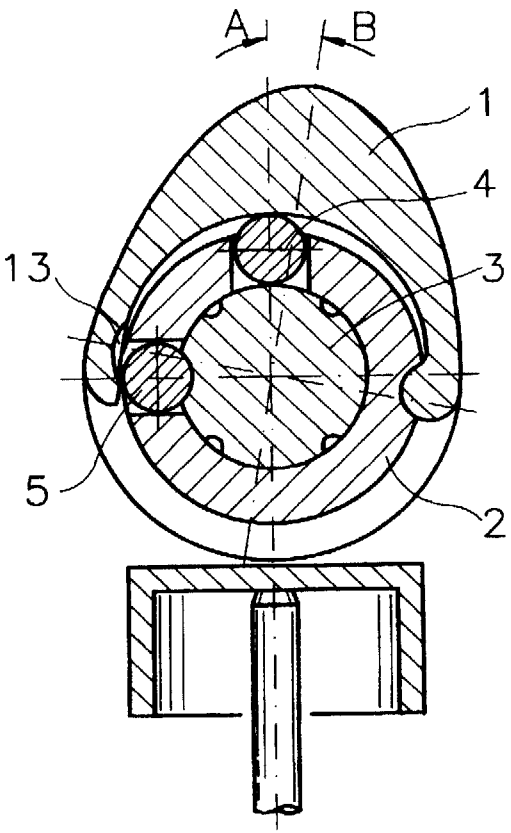
FIG. 14 is a cross-sectional view of the cam lobe with angular movement, along section line 14—14 of FIG. 13.
Figure 13:
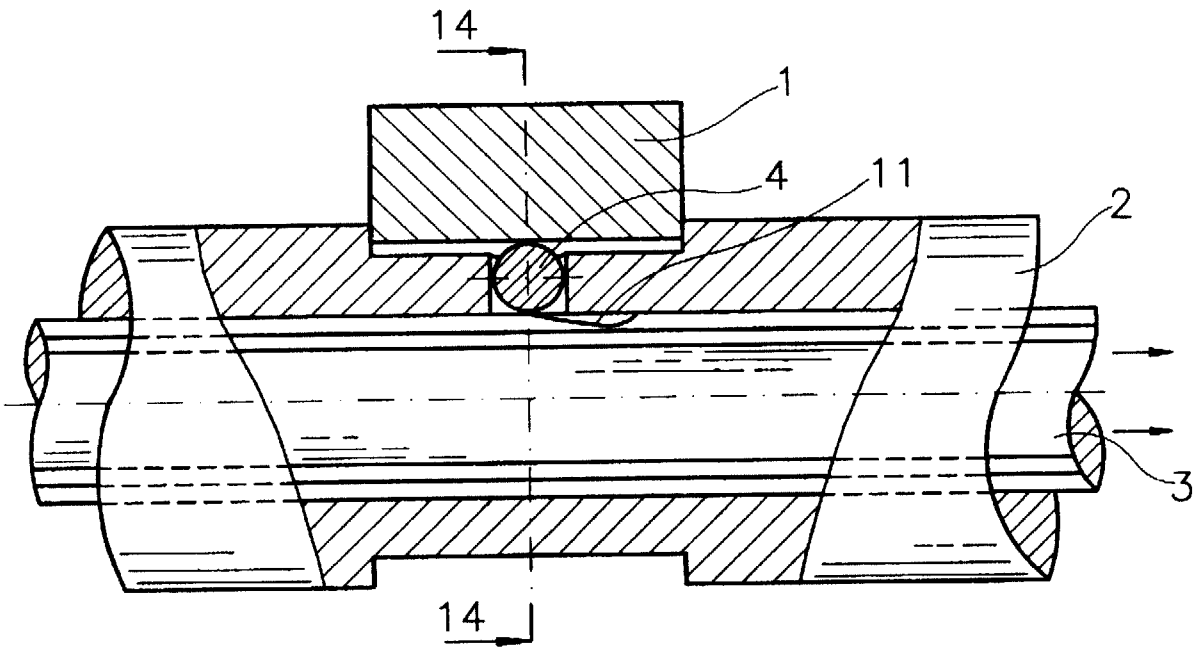
FIG. 13 is a partial sectional view of the cam lobe with angular movement in the end position.
Figure 15:
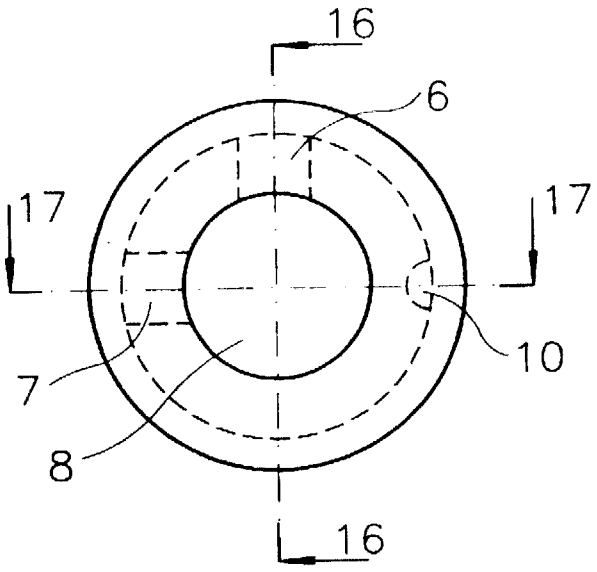
FIG. 15 is a side view of a rotating longitudinal shaft.
Figure 16:
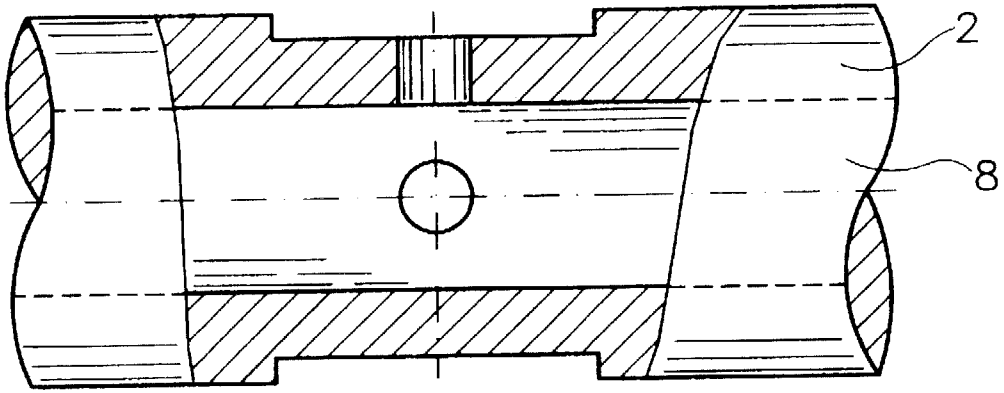
FIG. 16 is a partial sectional view of the rotating longitudinal shaft, along section line 16—16 of FIG. 15.
Figure 17:
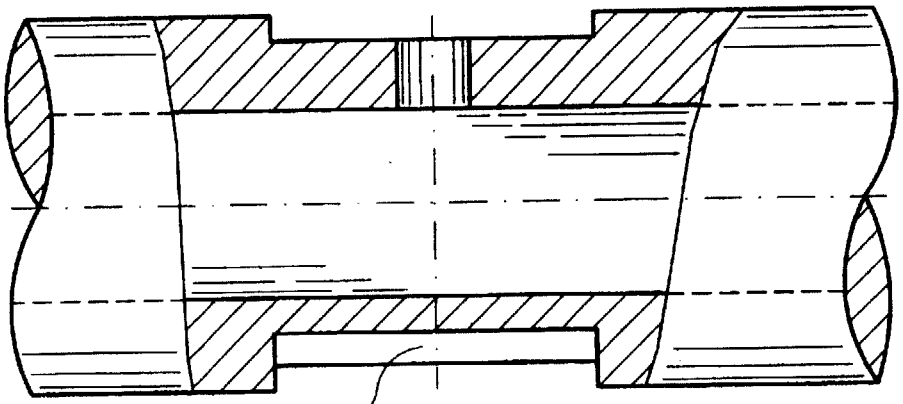
FIG. 17 is a partial sectional view of the rotating longitudinal shaft, along section line 17—17 of FIG. 15.

A first embodiment of a cam lobe with angular movement shown in FIGS. 1–8 consists of a U-shaped cam lobe 1, a cylindrical shaft 2, a transmission shaft or a reciprocating shaft 3, a first ball 4 and a second ball 5.

A longitudinal bulge 9, disposed at an end of a first arm of the cam lobe, is supported in a longitudinal groove 10 of the cylindrical shaft 2. The longitudinal bulge 9 and the longitudinal groove 10 of the cylindrical shaft 2 form a joint, where the cam lobe is rotatable around said joint. The cylindrical shaft 2 has a borehole 8 drilled through the whole length, through which the lubrication means is circulated for the lubrication of the shaft bearings. The transmission shaft 3 is movably disposed in the borehole 8 and is able to move gradually along an axis of the cylindrical shaft 2 in both directions. The transmission shaft 3 is grooved on a surface with an appropriate number of longitudinal grooves 14, which grooves 14 can be parallel or helical or of any other type to allow circulation of a lubricating means. A first recess 11 and a second recess 12 are made in the surface of the transmission shaft 3 and are shifted at 90° relative to each other in a plane perpendicular to the longitudinal axis of the transmission shaft 3. The first recess 11 and the second recess 12 are inclined relative each other and the slope of the first recess and the slope of the second recess are aligned to different directions.

The cylindrical shaft 2 has a first transverse borehole 6 and a second transverse borehole 7. The first transverse borehole 6 and the second transverse borehole 7 meet the longitudinal borehole 8 and are also inclined in such a way as to coincide with the direction of the first recess 11 and, respectively, of the second recess 12 of the transmission shaft 3.

The movement of the transmission shaft 3 along the axis of the cylindrical shaft 2 forces the first ball 4 to slide inside the borehole 6 and, as it emerges, to push the cam lobe thereby causing a rotation of the cam lobe 1 around its joint, formed by the longitudinal bulge 9 and the longitudinal groove 10.

During this gradual movement of the cam lobe, the symmetry axis of the cam lobe 1 is shifted by a specific angle from the initial position to the end position. The end position of the movement of the cam lobe 1 may be defined, depending on the choice of rotation point location, the size of the first ball 4, the size of the second ball 5, the size of the first recess 11 and the size of the second recess 12 of the shaft 3.

The cam lobe 1 is secured with the help of the second ball 5 and a lobe recess 13 in the end position, which lobe recess 13 is made in the inner surface of a second arm of the cam lobe 1.

When the transmission shaft 3 moves back, the second ball 5, which slides inside the hole 7, enters the lobe recess 13 of the cam lobe, thereby forcing the cam lobe 1 to return gradually to the intermediate position or to the initial position. In this movement, the cam lobe is additionally pushed by the force of the spring of the respective valve.

Figure 18:
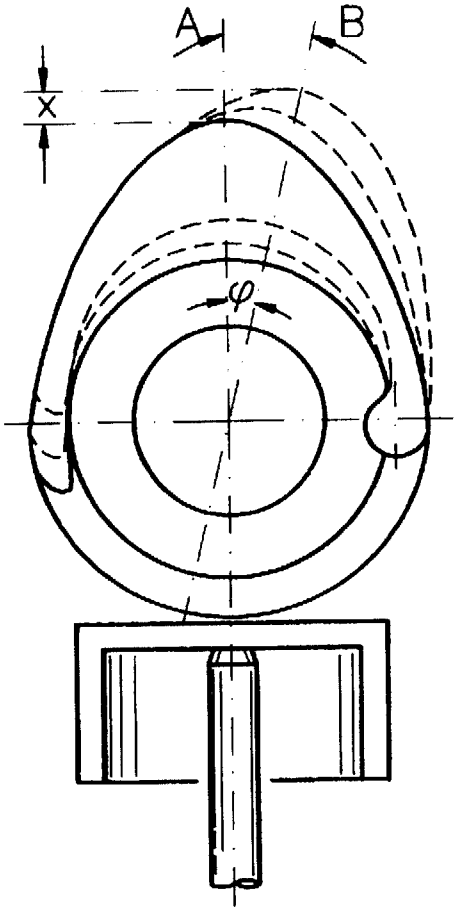
FIG. 18 is a side view of the cam lobe with angular movement, in the initial position, the intermediate position, and in the end position.
Figure 22:
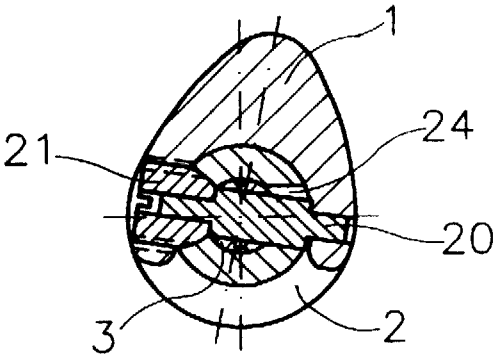
FIG. 22 is a cross-sectional view of the embodiment of the cam lobe with angular movement, driven by the pin, along section line 22—22 of FIG. 21.
Figure 24:
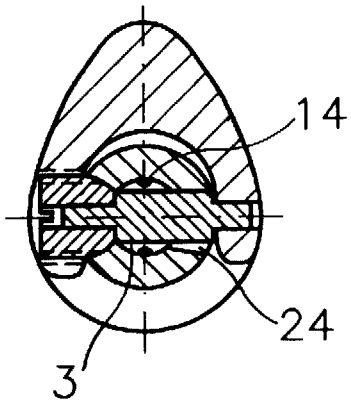
FIG. 24 is a cross-sectional view of the embodiment of the cam lobe with angular movement, driven by the pin, along section line 24—24 of FIG. 23.
Figure 21:
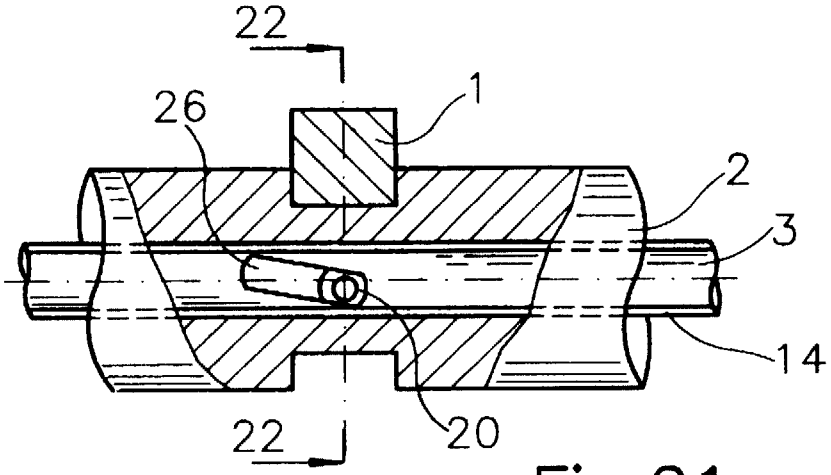
FIG. 21 is a partial sectional view of another embodiment of the cam lobe with angular movement, driven by a pin, in an initial position.
Figure 23:
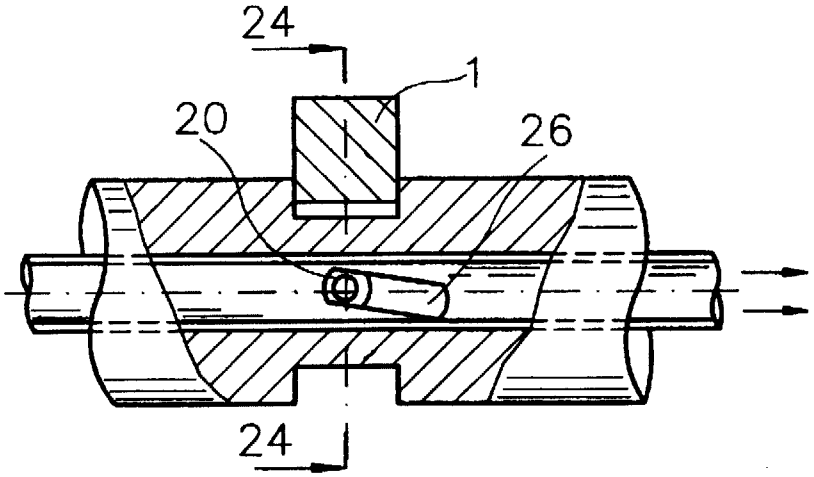
FIG. 23 is a partial sectional view of another embodiment of the cam lobe with angular movement, driven by a pin, in an end position.
Figure 25:
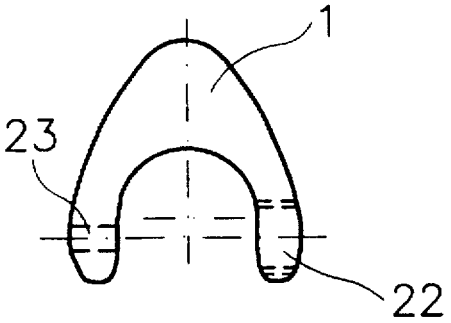
FIGS. 25–41 are views, cross-sectional views, and sectional views of parts of the embodiment of the cam lobe with angular movement, driven by the pin.
Figure 26:
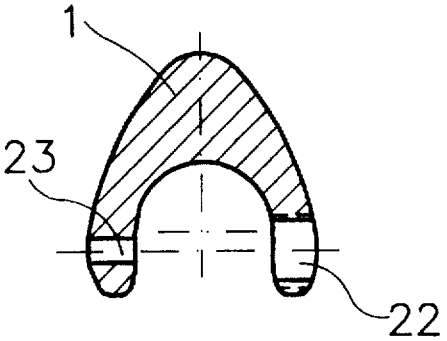
Figure 27:
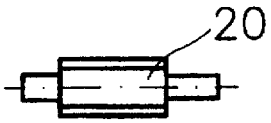
Figure 28:
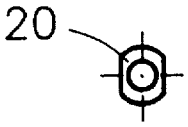
Figure 29:
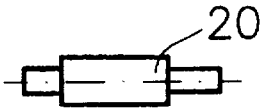
Figure 30:
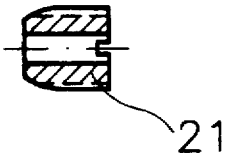
Figure 31:
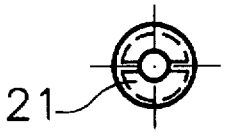
Figure 32:
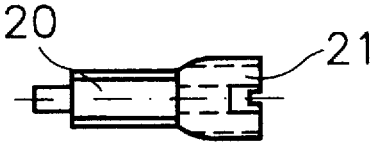
Figure 33:
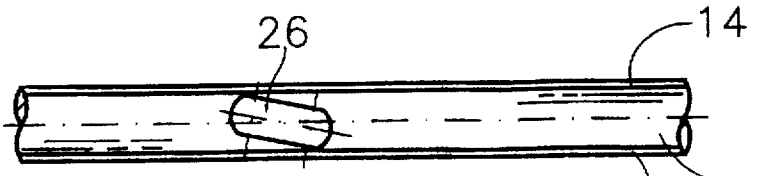
Figure 34:
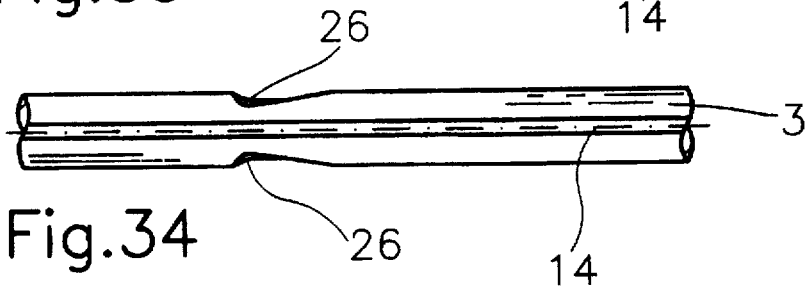
Figure 35:
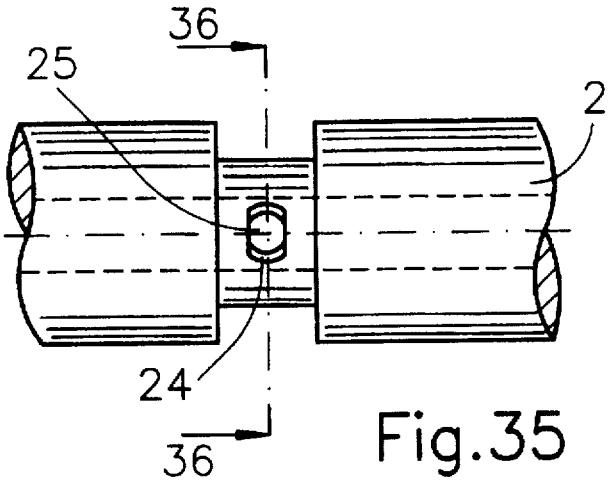
Figure 36:
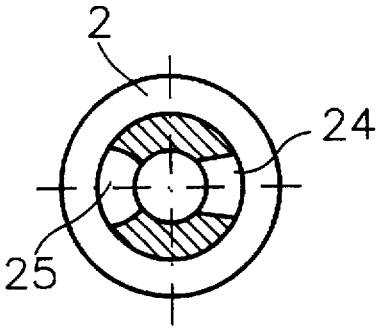
Figure 37:
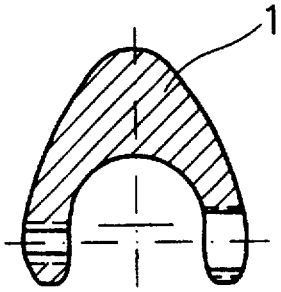
Figure 38:
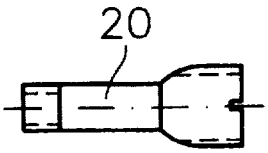
Figure 39:
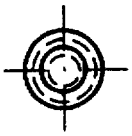
Figure 40:
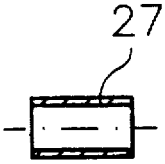
Figure 41:
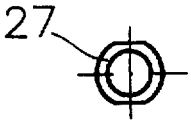

During the angular gradual movement of the symmetry axis of the cam lobe, which is achieved according to the above described rotation of the cam lobe around a fixed point, located offset from the symmetry axis of the cam lobe, the intended simultaneous gradual change of the valve lift "x" (marked in FIG. 18) and the valve timing is achieved (phase change to a degree "fi" as well as times of opening and of closing of the valve).

The cam lobe is shaped in such a way that the cam lobe cooperates with the cylindrical longitudinal shaft at any position during its movement, with the purpose of achieving at all times a smooth contact with the respective lifter and with the purpose of avoiding unwanted noises.

Figure 20:
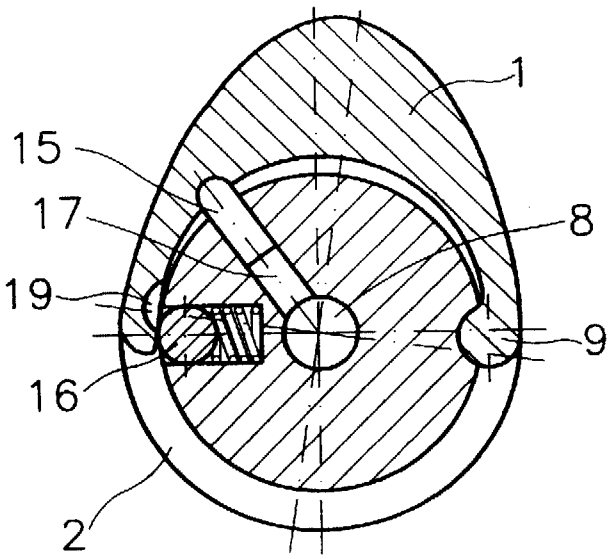
FIG. 20 is a cross-sectional view of the embodiment of the cam shaft with angular movement, driven hydraulically, in an end position.
Figure 19:
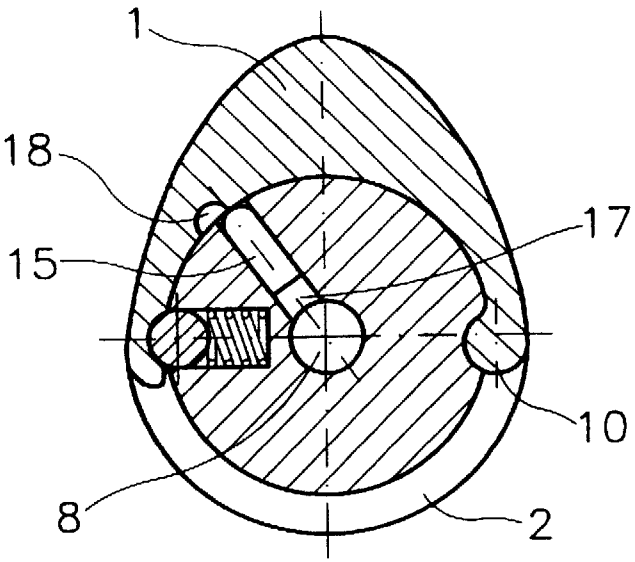
FIG. 19 is a cross-sectional view of an embodiment of the cam shaft with angular movement, driven hydraulically, in an initial position.

Another embodiment of the cam lobe with angular movement is shown in FIGS. 19 and 20. The movement of the cam lobe 1 is caused by a small piston 15 having a spherically shaped end. A third ball and a return spring 16 secure the cam lobe 1 in the initial position.

The cam lobe 1 has the longitudinal bulge 9 and the cylindrical shaft 2 has the longitudinal groove 10 for the formation of the joint, as it was described in connection with the previous embodiment.

The cylindrical shaft 2 has a transverse borehole 17, disposed inclined relative to the symmetry axis of the cylindrical shaft 2, and meeting the longitudinal borehole 8 of the cylindrical shaft 2.

Hydraulic means are delivered under pressure (e.g. oil) through the longitudinal borehole 8, which pushes the piston 15, wherein the piston 15 in turn slides within the transverse borehole 17 and enters with the spherically shaped end inside the spherical recess 18, made in the second arm of the cam lobe. This movement of the piston results in the angular movement of the cam lobe around the joint and causes a change in the lift and timing of the respective valve.

By interrupting the pressure of the hydraulic means, the cam lobe returns to its initial position with the help of the third ball, the return spring 16, and the specially designed recess 19 on the side of the cam lobe.

In yet another embodiment of the cam lobe with angular movement shown in FIGS. 21–41, the cam lobe 1 is rotated by the transmission shaft 3, the specially shaped pin 20, and the specially threaded component 21.

The cam lobe has a threaded borehole 22 made in one arm and a borehole 23 made in the other arm of the cam lobe.

The cylindrical shaft 2 has two boreholes 24, 25 in the area of the cam lobe, which boreholes meet the longitudinal hole of the cylindrical shaft 2. One borehole 24 has two opposite flat sides and two opposite semicylindrical sides, whereas the hole 25 has a spherical shape.

The pin 20 is shaped in such a way that both ends have a round cross-section, whereas the middle part of the pin 20 has a prismatic shape with two flat sides and two semicylindrical sides.

The specially threaded component 21 has a cylindrical shape. One of the ends of the threaded component 21 is shape-matching the spherical shape of the borehole 25 of the cylindrical shaft 2. The outer surface of the threaded component 21 is threaded such that it fits to the threaded hole 22 of the cam lobe. A borehole is drilled longitudinally through the whole length of the threaded component 21, where the diameter of said borehole corresponds to the end of pin 20. The slot on the flat side of the threaded component is used for screwing and unscrewing the threaded component.

The transmission shaft 3 has also a borehole 26 drilled through the whole diameter of the transmission shaft in addition to the longitudinal grooves 14 made on its outer surface for the circulation of the lubricating means. Two opposite walls of the borehole 26 are flat and parallel, while the two other walls have a semicylindrical shape. The flat walls of the borehole 26 are inclined relative to the symmetry axis of the transmission shaft.

The transmission shaft 3 is inserted into the longitudinal borehole of the cylindrical shaft 2. The cam lobe 1 is assembled on the cylindrical shaft 2 in such a way that the axes of the boreholes 22, 23, 24, 25 and 26 coincide. The pin 20 passes through all the above mentioned boreholes. A first cylindrical end of the pin is inserted into the borehole 23, the prismatic-shaped middle part passes through the borehole 26 and a second cylindrical end is inserted into the borehole 22. The borehole 22 is threaded, and the specially threaded component 21 is screwed into the thread of the borehole 22. The whole system is secured in this way. In addition, the spherical end of the threaded component 21 and the respective spherical borehole 25 of the cylindrical shaft 2 form a joint around which the cam lobe is able to rotate. Tolerance of the whole fit is achieved through the gradual proper screwing or unscrewing of the component 21.

The prismatic-shaped middle part of the pin 20 and the borehole 26 of the shaft 3 are machined so that they can fully cooperate with each other.

An operating principle of the cam lobe with angular movement is described below. The movement of the transmission shaft 3 forces the pin 20 to slide on the inclined flat sides of the borehole 26 and to be raised or to be lowered in respect to its former position, depending on the direction of the movement of the transmission shaft 3.

This movement of the pin 20 forces the cam lobe 1 to rotate along the joint created, as mentioned above, between the component 21 and the borehole 25 of the cylindrical shaft 2. The slope of the flat walls of the borehole 26, the length of the borehole 26, as well as the length of the borehole 24 of the cylindrical shaft 2 define the maximum travel path of the pin 20 and, consequently, the end position of the rotational movement of the cam lobe.

The pin 20 is machined with a prismatic-shaped middle part, with two flat sides or end sections, such that during the cooperation of the middle part with the respective walls of the borehole 26, the wear rate of the material will be reduced. This wear rate would have been much greater in the case of a cylindrical-shaped pin and, consequently, the cooperation of the cylindrical-shaped pin with the sides or end sections of the respective opening 26 would have been along a line and not along a flat surface, as it is presented in the described embodiment.

The cam lobe cooperates smoothly with the cylindrical shaft in any position during its movement.

In a variation of this system, the pin 20 has a special design, as seen in FIGS. 38–41, where both ends of the pin 20 are threaded. The middle part is no longer of a prismatic shape but of a cylindrical shape. Also, in this variation, if is desired, the borehole 23 of the cam lobe 1 is threaded similar to the thread of pin 20. The pin 20 passing through the boreholes 23, 24, 25, and 26 is screwed with one end into the borehole 23 and with the other end into the borehole 22. In this way, the system is secured in a better way, especially in the cases where the center of rotation (joint) of the cam lobe is required to be located somewhat further apart from the cylindrical shaft 2. In order to have a greater mating surface between the pin and the walls of borehole 26, as compared to the case of the prismatic-shaped middle part pin 20, a tube 27 with two flat parallel sides is inserted into the borehole 26. Then, the pin 20 is inserted into the tube 27. The flat sides of the tube 27 come into contact with the walls of the borehole 26 instead of the cylindrical pin.

Figure 42:
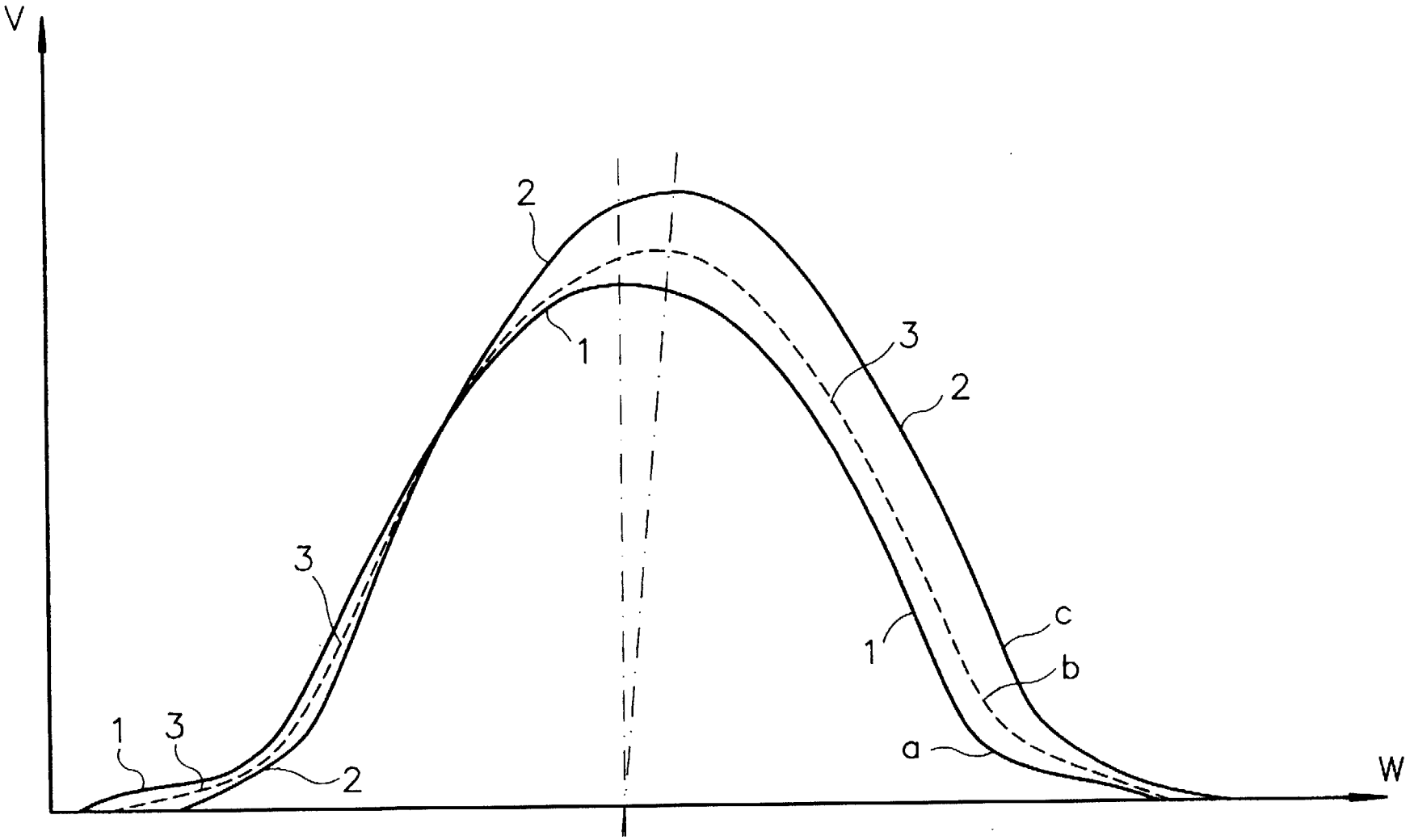
FIG. 42 are diagrams showing operational characteristics (cam lift).

FIG. 42 illustrates some of the valve lift curve variations. The curve a represents the valve lift when the cam lobe is in the initial position.

The curves b and c represent the valve lift in an intermediate and in an end position of the cam lobe, respectively.

From the above mentioned diagrams it is clear how the cam lobe modifies the operational characteristics of the valve, during the movement of the cam lobe and, consequently, how the cam lobe improves the performance of the respective motor in the whole operational RPM range.

It will be understood that each of the elements described above, or two or more together, may also find a useful application in other types of camshafts differing from the types described above.

While the invention has been illustrated and described as embodied in the context of a cam lobe with angular movement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention. What is claimed as new and desired to be protected by Letters Patent is set forth in the appended claims:

What is claimed is:

1. A cam lobe angular movement system attached to a rotating shaft, comprising:

a U-shaped cam lobe having a symmetry axis, wherein said U-shaped cam lobe is disposed rotatable around a fixed point located offset relative to the symmetry axis of the U-shaped cam lobe;

a rotating cylindrical shaft supporting the cam lobe;

means for rotating the U-shaped cam lobe around said fixed point located offset relative to the symmetry axis of the U-shaped cam lobe and for causing a defined angular motion of the cam lobe around the fixed point, resulting in a simultaneous gradual change of operational parameters of a valve, namely: i) a phase of operation, ii) a lifting stroke, and iii) an opening—closing duration.

2. The cam lobe angular movement system according to claim 1, wherein a) the fixed point of rotation of the U-shaped cam lobe is disposed in any point of a side of the cam lobe and the cam lobe angular movement system is constructed such that a gradual rotation of the U-shaped cam lobe around the fixed point is performed;

b) a lower part of an inner side of the U-shaped cam lobe is constructed such that a smooth conjunction of the inner side of the U-shaped cam lobe and the rotating cylindrical shaft is provided in all positions of the U-shaped cam lobe.

3. The cam lobe angular movement system according to claim 1, further comprising a transmission shaft, wherein the rotating cylindrical shaft comprises a longitudinal borehole, wherein the transmission shaft reciprocates inside the longitudinal bore, a first transverse borehole disposed in the rotating cylindrical shaft and matching a position of the longitudinal borehole, a second transverse borehole inclined relative to the first transverse hole and matching a position of the longitudinal borehole, a longitudinal groove furnished in an outer surface of the rotating cylindrical shaft and running parallel to an axis of the rotating cylindrical shaft, and wherein the U-shaped cam lobe comprises a small recess furnished in an inner surface of a first arm of the U-shaped cam lobe, a longitudinal bulge shape-matching the longitudinal groove of the rotating cylindrical shaft and furnished at an end of a second arm of the U-shaped cam lobe, wherein the longitudinal bulge of the second arm of the U-shaped cam lobe and the longitudinal groove of the rotating cylindrical shaft furnish a fixedly placed joint, and wherein said U-shaped cam lobe rotates around an axis of the joint, and wherein the axis of the fixedly placed joint runs parallel to the axis of the rotating cylindrical shaft and runs offset relative to the symmetry axis of the U-shaped cam lobe, and wherein the transmission shaft has a first recess and a second recess shifted by 90° relative each other in a plane perpendicular to the axis of the rotating cylindrical shaft and wherein the first recess and the second recess are inclined relative each other, and wherein a slope of the first recess and a slope of the second recess are aligned to different directions, and wherein the first recess and the second recess are also inclined in such a way as to coincide with direction of the first transverse borehole and, respectively, of the second transverse borehole of the cylindrical shaft, and wherein a first ball is disposed in the first transverse borehole and a second ball is disposed in the second transverse borehole, and wherein movement of the transmission shaft along the axis of the cylindrical shaft forces the first ball to slide inside the first borehole and to push the U-shaped cam lobe thereby causing a rotation of the U-shaped cam lobe around the fixedly placed joint.

4. The cam lobe angular movement system according to claim 3, wherein the first ball and the second ball slide in opposite direction in the first recess and, respectively, in the second recess of the transmission shaft and secure the U-shaped cam lobe on a surface of the rotating cylindrical shaft.

5. The cam lobe angular movement system according to claim 1, wherein the U-shaped cam lobe has a small borehole furnished in a first arm of the cam lobe and a threaded borehole furnished in a second arm of the cam lobe, and wherein the rotating cylindrical shaft is provided with two boreholes meeting the longitudinal borehole of the rotating cylindrical shaft wherein a first borehole of the two boreholes has two opposite flat sides and two opposite semi-cylindrical sides and a second borehole of the two boreholes has spherical shape, and wherein the transmission shaft is provided with a borehole with two opposite flat parallel walls inclined relative to an axis of the transmission shaft, and wherein the transmission shaft is inserted into a longitudinal borehole of the cylindrical shaft in such a way that axes of the small borehole and of the threaded borehole of the U-shaped cam lobe, axes of the two boreholes of the rotating cylindrical shaft and an axis of the borehole of the transmission shaft coincide, and wherein a pin, having a prismatic middle part matchingly shaped the borehole of the transmission shaft, passes through the small borehole and threaded borehole of the U-shaped can lobe, through the two boreholes of the rotating cylindrical shaft, and through the borehole of the transmission shaft, secured bin the pin is secured by a threaded component screwed into the threaded borehole of the U-shaped cam lobe, and wherein the threaded component has a spherical end matching the second borehole of the two boreholes of the cylindrical shaft and wherein the threaded component inserted at the spherical end in the second borehole of the two boreholes creates a joint located in the fixed point located offset relative to the perpendicular symmetry axis of the U-shaped cam lobe, and wherein the U-shaped cam lobe performs an angular movement around said joint during sliding of the pin along the flat parallel walls of the borehole of the transmission shaft.

6. The cam lobe angular movement system according to claim 1, wherein the rotating cylindrical shaft includes a longitudinal borehole, a transverse borehole starting at an outer surface of the rotating cylindrical shaft and meeting the longitudinal borehole of the rotating cylindrical shaft, a longitudinal groove furnished in an outer surface of the rotating cylindrical shaft and running parallel to the axis of the rotating cylindrical shaft, a cylindrical recess furnished in the outer surface of the rotating cylindrical shaft, and wherein the cam lobe includes a first recess and a second recess furnished in an inner surface of the cam lobe, a longitudinal bulge shape-matching the longitudinal groove of the rotating cylindrical shaft and furnished at a second arm relative to a first arm whereon the first recess and the second recess are furnished, wherein the longitudinal bulge and the longitudinal groove furnish a joint for rotation the U-shaped cam lob, and wherein a small piston with a spherically shaped end inserted in the transverse borehole of the cylindrical shaft enters into the second recess of the U-shaped cam lobe thereby causing rotation of the U-shaped cam lobe up to an end position, and wherein the U-shaped cam lobe, when retracting to its initial position, is secured through a spring and third ball inserted into the first recess of the U-shaped cam lobe.

7. A cam lobe with offset angular movement system, aiming at simultaneous improvement of all operational characteristics of internal combustion engine valves, comprising:

a rotating cylindrical shaft having a longitudinal lubrication hole disposed in the rotating cylindrical shaft and running parallel to a longitudinal axis of the rotating cylindrical shaft, a first transverse hole disposed in the rotating cylindrical shaft and adjoining the longitudinal lubrication hole, a second transverse hole inclined relative to the first transverse hole and adjoining the longitudinal lubrication hole, a longitudinal groove furnished in an outer surface of the rotating cylindrical shaft and running parallel to the longitudinal axis of the rotating cylindrical shaft;

at least one U-shaped cam lobe placed on the rotating cylindrical shaft and having a first arm, a second arm, and a vertical symmetry axis perpendicular to a longitudinal axis of said U-shaped cam lobe and having a small recess furnished in an inner surface of the first arm of said U-shaped cam lobe, a longitudinal bulge shape-matching the longitudinal groove of the rotating cylindrical shaft and furnished at an end of the second arm of said U-shaped cam lobe, wherein the longitudinal bulge of the second arm of said U-shaped cam lobe and the longitudinal groove of the rotating cylindrical shaft furnish a fixedly placed joint, and wherein said U-shaped cam lobe rotates around an axis of the joint, and wherein the axis of the joint runs parallel to the longitudinal axis of the rotating cylindrical shaft and runs offset relative to the vertical symmetry axis of said U-shaped cam lobe;

a reciprocating shaft movably disposed and shiftedly located inside the longitudinal lubrication hole of the rotating cylindrical shaft and having a first recess and having a second recess disposed inclined in opposite directions;

a first sliding ball moving inside the first transverse hole of the rotating shaft, wherein the first sliding ball cooperates with the first recess of the reciprocating shaft, and wherein the first sliding ball additionally cooperates with the small recess furnished in the inner surface of the first arm of said U-shaped cam lobe;

a second sliding ball moving inside the second transverse hole of the rotating shaft, wherein the second sliding ball cooperates with the second recess of the reciprocating shaft, and wherein the first sliding ball and the second sliding ball move upon shifting of the reciprocating shaft along the longitudinal axis of the rotating cylindrical shaft, and wherein said U-shaped cam lobe thereby rotates angularly around the axis of the joint, and wherein a distance between a top of said U-shaped cam lobe and a center of a cross-section of the rotating cylindrical shaft is thereby changed, and wherein operational parameters of a valve cooperating with said U-shaped cam lobe are thereby changed, namely:

i) a timing phase, ii) a valve lift, and iii) an opening—closing duration of said valve.

8. The cam lobe with offset angular movement system, according to claim 7, wherein the axis of the joint is placed in any line, running parallel to the longitudinal axis of the rotating cylindrical shaft, and the joint is placed on an inner surface of said U-shaped cam lobe, and wherein the joint is designed to allow a gradual rotation of said U-shaped cam lobe around the axis of the joint and to allow a gradual angular movement of the vertical symmetry axis of said U-shaped cam lobe, changing thereby the operational parameters of the respective valve cooperating with said U-shaped cam lobe by changing timing phase, lifting, duration of said respective valve, and wherein the outer surface of said U-shaped came lobe is shaped such as to achieve a smooth coincidence of the outer surface of said U-shaped cam lobe and an outer surface of the rotating cylindrical shaft in all positions of said U-shaped cam lobe, and wherein a shape of the small recess, furnished in the inner surface of the first arm of said U-shaped cam lobe, allows initially a securing of said U-shaped cam lobe through the first sliding ball while said U-shaped cam lobe bears on the rotating shaft and later on a final position of U-shaped cam lobe.

9. The cam lobe with offset angular movement system, according to claim 7, wherein the reciprocating shaft has longitudinally running lubrication grooves.

10. The cam lobe with offset angular movement system, according to claim 7, wherein the first sliding ball and the second sliding ball secure said U-shaped cam lobe on the outer surface of the rotating cylindrical shaft in any position of said U-shaped cam lobe.

11. A cam lobe with offset angular movement system, aiming at simultaneous improvement of all operational characteristics of internal combustion engine valves, comprising:

a rotating cylindrical shaft having a longitudinal hole running parallel to a longitudinal axis of the rotating cylindrical shaft, a transverse borehole starting at an outer surface of the rotating cylindrical shaft and meeting the longitudinal hole and running along a symmetry axis of a cross section of the rotating cylindrical shaft, a longitudinal groove furnished in an outer surface of the rotating cylindrical shaft and running parallel to the longitudinal axis of the rotating cylindrical shaft, a cylindrical recess furnished in the outer surface of the rotating cylindrical shaft;

at least one cam lobe placed on the rotating cylindrical shaft and having a vertical symmetry axis perpendicular to a longitudinal axis of the cam lobe and a U-shaped inner surface and having a first recess and a second recess furnished in the inner surface of the cam lobe, a longitudinal bulge shape-matching the longitudinal groove of the rotating cylindrical shaft and furnished on the U-shaped inner surface of the cam lobe and placed on an other arm than those arms where the first recess and the second recess are furnished, wherein the longitudinal bulge and the longitudinal groove furnish a joint and wherein the joint is placed in a fixed point of rotation of the cam lobe and wherein the fixed point is placed offset from the vertical symmetry axis of the cam lobe;

a sliding ball movably placed in the cylindrical recess and meeting the first recess of the cam lobe in an initial position of the cam lobe;

a spring placed in the cylindrical recess and acting on the sliding ball and securing together with the sliding ball the initial position of the cam lobe; and a small piston having a spherically shaped end and movably placed in the transverse borehole and cooperating with the second recess of the cam lobe wherein pressure of hydraulic fluid acting on the small piston through the longitudinal hole of the rotating cylindrical shaft causes changing an angular position of the cam lobe around the fixed point of rotation of the cam lobe thereby changing a distance between a top of the came lobe and the longitudinal axis of the rotating cylindrical shaft and thereby changing operational parameters of a valve cooperating with the cam lobe, namely:

i) a timing phase, ii) a valve lift, and iii) an opening—closing duration of said valve, and wherein the small piston secures a final position of the cam lobe being inserted in the second recess.

12. A cam lobe with offset angular movement system, comprising:

a rotating cylindrical shaft having a longitudinal lubrication hole running parallel to a longitudinal axis of the rotating cylindrical shaft, a borehole running along a symmetry axis of a cross-section of the rotating cylindrical shaft;

at least one cam lobe having a first arm and having a second arm and placed on the rotating cylindrical shaft and having a vertical symmetry axis perpendicular to a longitudinal axis of the cam lobe and a U-shaped inner surface and having a small hole furnished in the first arm of the cam lobe and a threaded borehole furnished in the second arm of the cam lobe and running along a longitudinal axis of the small hole;

a reciprocating shaft placed shiftedly inside the longitudinal lubrication hole of the rotating shaft and having a transverse opening with two opposite flat parallel sides having an axis inclined with respect to the longitudinal axis of the rotating cylindrical shaft; and a pin matching the transverse opening of the reciprocating shaft and the small hole and threaded borehole of the cam lobe and inserted in the borehole of the rotating cylindrical shaft, the transverse opening of the reciprocating shaft and the small hole and threaded borehole of the cam lobe, wherein the pin connects the rotating cylindrical shaft, the cam lobe, and the reciprocating shaft and furnishes a joint, wherein the cam lobe performs an angular movement around said joint, and wherein during shifting the reciprocating shaft is inside the rotating cylindrical shaft and the pin slides along sides of the transverse opening thereby creating a gradual uniformly changing angular position of the cam lobe in relation to the rotating cylindrical shaft and changing operational parameters of a valve cooperating with the cam lobe, namely:

i) a timing phase, ii) a valve lift, and iii) an opening—closing duration of said valve.

13. The cam lobe with offset angular movement system, according to claim 12, wherein the pin has a prismatic-shaped middle part to reduce a wear rate of the two opposite flat parallel sides of the transverse opening and the pin.

14. The cam lobe with offset angular movement system, according to claim 12, wherein the pin has a round cross-section in a middle part, and wherein the pin is inserted into a tube placed into the transverse opening.

* * * * *

UNITED STATES PATENT AND TRADEMARK OFFICE

CERTIFICATE OF CORRECTION

PATENT NO. : 5,746,166

DATED : May 5, 1998

INVENTOR(S) : Christos Valasopoulos

It is certified that error appears in the above-identified patent and that said Letters Patent is hereby corrected as shown below:

- Column 9, line 45:

delete "can" and insert --cam--

- Column 9, line 47:

delete "secured bin" and insert --and wherein--

Signed and Sealed this

Seventeenth Day of November, 1998

*Attest:*

*Attesting Officer*

BRUCE LEHMAN

*Commissioner of Patents and Trademarks*